US008834635B2

(12) United States Patent
Bayarri Ferrer et al.

(10) Patent No.: US 8,834,635 B2
(45) Date of Patent: Sep. 16, 2014

(54) DEGREASING COMPOSITIONS DERIVED FROM LEVULINIC ACID (A COMPOUND OBTAINABLE FROM BIOMASS) AND PROCESS FOR DEGREASING METAL SURFACES

(75) Inventors: Natividad Bayarri Ferrer, Mollet del Valles (ES); Lidia Galià Prats, Mollet del Valles (ES); Carles Estévez Company, Mollet del Valles (ES); Josep Castells Boliart, Mollet del Valles (ES)

(73) Assignee: Institut Univ. de Ciencia Tecnologia, S.A., Molet del Vallés (ES)

( * ) Notice: Subject to any disclaimer, the term of this patent is extended or adjusted under 35 U.S.C. 154(b) by 0 days.

(21) Appl. No.: 14/128,789

(22) PCT Filed: Jun. 28, 2012

(86) PCT No.: PCT/EP2012/062557

§ 371 (c)(1),
(2), (4) Date: Dec. 23, 2013

(87) PCT Pub. No.: WO2013/000998

PCT Pub. Date: Jan. 3, 2013

(65) Prior Publication Data

US 2014/0123998 A1 May 8, 2014

(30) Foreign Application Priority Data

Jun. 29, 2011 (EP) ..... 11382221

(51) Int. Cl.

| | |
|---|---|
| ***B08B 3/12*** | (2006.01) |
| ***C11D 7/26*** | (2006.01) |
| ***C23G 5/032*** | (2006.01) |
| ***C11D 7/50*** | (2006.01) |

(52) U.S. Cl.

CPC ..... *C23G 5/032* (2013.01); *C11D 7/266* (2013.01); *C11D 7/5022* (2013.01)

USPC ..... 134/1; 134/2; 134/10; 134/40; 134/42; 510/245

(58) Field of Classification Search

CPC ..... B08B 3/00; B08B 3/02; B08B 3/024; B08B 3/04; B08B 3/08; B08B 3/10; B08B 3/12; B08B 7/02; C23G 5/032; C23G 5/00

USPC ..... 134/1, 2, 10, 40, 42; 510/245

See application file for complete search history.

(56) References Cited

U.S. PATENT DOCUMENTS

| | | | | |
|---|---|---|---|---|
| 5,482,645 | A | 1/1996 | Maruyama et al. | |
| 2012/0040880 | A1 * | 2/2012 | Rieth et al. | 510/138 |
| 2012/0128614 | A1 * | 5/2012 | Rieth et al. | 424/70.1 |

FOREIGN PATENT DOCUMENTS

| | | |
|---|---|---|
| WO | 03/016449 | 2/2003 |
| WO | 2011/107712 | 9/2011 |

OTHER PUBLICATIONS

Guerrero et al. "PpT Behavior of Several Chemicals from Biomass", Energy Fuels, 2011, 25, 3009-3013.*

International PCT Search Report and Written Opinion for PCT Application No. PCT/EP2012/062557, completed Sep. 28, 2012.

* cited by examiner

*Primary Examiner* — Bibi Carrillo

(74) *Attorney, Agent, or Firm* — Barnes & Thornburg LLP

(57) ABSTRACT

The present invention relates to a new degreasing composition comprising at least one levulinic acid ester according to general formula (I) $CH_3CO(CH_2)_2COOR^1$ (I) in which $R^1$ is a linear or branched, saturated or unsaturated, aliphatic or aromatic, hydrocarbon radical having 2 to 56 carbon atoms, wherein said hydrocarbon radical is optionally hydroxysubstituted. The present invention also relates to a process for degreasing a metal surface comprising the step of contacting said metal surface with the composition of the present invention.

18 Claims, 4 Drawing Sheets

DEGREASING COMPOSITIONS DERIVED FROM LEVULINIC ACID (A COMPOUND OBTAINABLE FROM BIOMASS) AND PROCESS FOR DEGREASING METAL SURFACES

CROSS-REFERENCE TO RELATED APPLICATIONS

This application is a national stage entry under 35 U.S.C. §371(b) of International Application No. PCT/EP2012/062557, filed Jun. 28, 2012, which claims the benefit of European Patent Application Serial No. 11382221.7, filed Jun. 29, 2011, the disclosures of which are hereby incorporated herein by reference.

FIELD OF THE INVENTION

The present invention relates to a new enviromentally friendly solvent composition derived from levulinic acid for degreasing metal surfaces which are used in a wide range of industrial sectors (i.e., automotive, construction, electronics), as well as a process for degreasing metal surfaces.

BACKGROUND OF THE INVENTION

Metal protectors are used to avoid corrosion of metals during their manufacture, storage, and transportation. Metal parts or surfaces must be degreased prior to subsequent metal processing operations. Over the past few years, major efforts have been made on the development of greener solvents as alternatives to chlorinated solvents such as trichloroethylene as degreasing agents in metal surface processing.

Several nitrogen-containing solvent compositions derived from natural fatty acids have recently been proposed as alternatives to chlorinated-based solvent compositions for degreasing metal surfaces (J. Bigorra, J. Raya, R. Valls, C. Estévez, L. Galià and J. Castells, EP 08 007 673.0, 2008 (Cognis/IUCT). While these solvents are as efficient as trichloroethylene in terms of degreasing efficacy, they also display intrinsic low VOC emission potential and a much better environmental, health and safety profile.

The present inventors have developed new nitrogen-free solvent compositions derived from levulinic acid. Levulinic acid can be obtained from a wide range of feedstocks including sucrose, starch, and lignocellulose. The preparation of levulinic acid from carbohydrates by the action of mineral acids is known from G. J. Mulder, J. Prakt. Chem. 21, 219 (1840), cited in U.S. Pat. No. 5,189,215. However, poor yields of levulinic acid are obtained (<25%) due to the formation of formic acid and other by-products, which reduce significantly the selectivity of the reaction. Recent technological advancements have circumvented the yield and selectivity problem and provide cost-effective technologies to manufacture cheap levulinic acid at large scale. For example, Fitzpatrick et al. (U.S. Pat. No. 4,897,947) disclose a method of degrading lignocellulose to furfural and levulinic acid. Ghorpade, et al. (U.S. Pat. No. 5,859,263).

More particularly, the present invention intends to replace commercial degreasing solvents known in the market by new compositions which are more efficient, safer and friendlier to the environment, and allow to perform metal degreasing operations in highly variable settings, with metal surfaces of different size and shape, minimizing diffuse emission, release of contaminated air during loading and unloading, and solvent release from cleaned metal surfaces.

Hernando Guerrero et al, in "PpT Behaviour of Several Chemicals from Biomass", ENERGY FUELS, Vol. 25, no 7, 6 Jun. 2011, pages 3009-3013, discloses the study of physicochemical properties of several presumably solvents with the provision of pressure-density-temperature data. Among them ethyl levulinate and butyl levulinate are cited but there is no mention nor suggestion that these compounds can behave as a degreasing composition nor even as a solvent. Results and discussion of this document do not lead to any conclusion about the industrial application for these compounds.

WO2011/107712 relates to a method for synthesising a composition including at least one biomass-derived acid ester and an organic biosolvent. Said method is carried out by reacting at least one biomass-derived acid and at least one alcohol in the presence of an acid catalyst and the organic biosolvent finally obtaining a mixture of ester and biosolvent. None of the examples shown employ levulinic acid so as to obtain the corresponding ester and no intended use as a degreasing composition is mentioned or suggested for the levulinic acid ester employed. Additionally, the product obtained with said synthesis is a mixture of compounds.

A first object of the present invention is to provide greener solvents for degreasing metal surfaces.

A second object of the present invention relates to a process for degreasing metal surfaces using the composition of the present invention.

A third object relates to the use of a composition of the present invention for degreasing metal surfaces.

A: Control (degreased with trichloroethylene)

B: Metal protected with cereous protector

C: LAOC-4 (Butyl levulinate); 10 min at 41° C.

Figure 5:
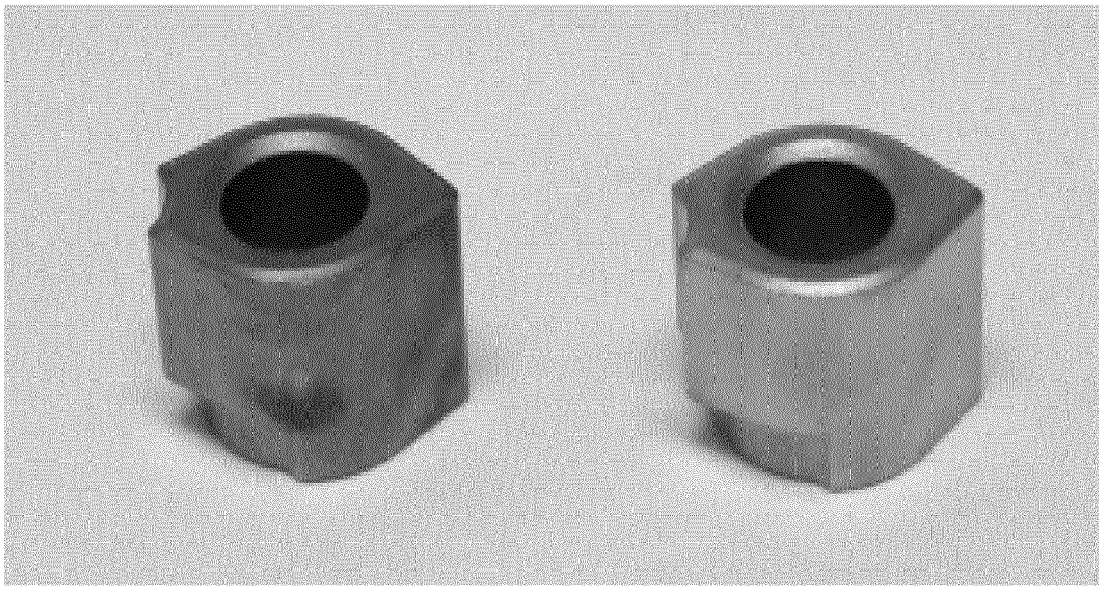

FIG. 5 shows the comparison of metal sinterized parts, wherein the dark part is protected with grease and the clear part shows a satisfactory removal of grease.

DETAILED DESCRIPTION OF THE INVENTION

The present invention relates in its first aspect to a new degreasing composition comprising at least one levulinic acid ester according to general formula (I)

$$CH_3CO(CH_2)_2COOR^1 \quad (I)$$

in which $R^1$ is a linear or branched, saturated or unsaturated, aliphatic or aromatic, hydrocarbon radical having 2 to 56 carbon atoms, wherein said hydrocarbon radical is optionally hydroxysubstituted. It should be understood that the figure of 56 carbon atoms can be possible when the corresponding alcohol moiety is composed of monomeric units linked by an oligomerization process. It is well known in the art that if the hydrocarbon radical $R^1$ is derived from natural fatty acids, the typical number of carbon atoms in the chain ranges from 6 to 22. In a preferred embodiment, said $R^1$ is an hydrocarbon radical having 2, 3, 4, 5, 6, 7, 8, 9, or 10 carbon atoms.

The levulinic acid for obtaining said levulinic acid ester can be obtained from any available source, but preferably from biomass since it is the main source for its obtaining nowadays.

Said degreasing action is undertaken over a metal surface (also known as metal parts in the art), understanding by "metal surface", surfaces of a metal in solid state, alloys in solid state and one or more metals in solid state previously submitted to surface treatment. Preferred metal surfaces are steel, stainless steel, cast iron, aluminium, and sinterized metals.

The degreasing action is preferably carried out over stains, grease and/or preservatives found on metal surfaces.

Surprisingly, it has been observed that esters of levulinic acid efficiently degrease metal surfaces with degreasing efficacies equivalent to trichloroethylene, regardless whether the metal surfaces have been protected by solvent-based or cereous metal preservative formulations. In addition, the composition of the present invention has a better (eco)-toxicological profile when compared to trichloroethylene which has been classified as probable carcinogen by many health authorities carrying a R45 risk phrase. The following table compares environmental, health and safety properties of three different levulinate esters.

| EHS Properties | LAOC4 | LAOC4i | LAOC5 |
|---|---|---|---|
| Cytotoxicity, in vitro NRU, IC50 (mg/mL). Experimental. | 5.7 Not cytotoxic | 4.4 Not cytotoxic | 16.6 Not cytotoxic |
| Mutagenicity, Ames Test. Experimental. | Not Mutagenic | Not Mutagenic | Not Mutagenic |
| Fish acute toxicity, experimental, LC50 (mg/L). Ready Biodegradability, Calculated. | <100 Yes Low ecotox. | <100 Yes Low ecotox. | <100 Yes Low ecotox. |
| VOC Classification according to vapor pressure. Calculated. | <0.1 hPa Not VOC | <0.1 hPa Not VOC | <0.1 hPa Not VOC |
| Flash Point, closed cup, ° C. Calculated. | 88 Low flam in | 70 Low flamm | 97 Low flamm |

LAOC4: Butyl levulinate
LACO4i: iso-butyl levulinate
LAOC5: pentyl levulinate

Therefore, from these data it is inferred that the composition disclosed herein presents excellent environment, health and safety (EHS) properties, in particular not being cytotoxic, not being mutagenic and not delivering volatile organic compounds (VOC).

A second object of the present invention relates to a process for degreasing a metal surface as defined herein such as those used in the manufacture of automotive and building components, comprising the step of contacting said metal surface with a composition comprising at least one levulinic acid ester according to general formula (I)

$$CH_3CO(CH_2)_2COOR^1 \quad (I)$$

in which $R^1$ is a linear or branched, saturated or unsaturated, aliphatic or aromatic, hydrocarbon radical having 2 to 56 carbon atoms, wherein said hydrocarbon radical is optionally hydroxysubstituted. In a preferred embodiment, said $R^1$ is an hydrocarbon radical having 2, 3, 4, 5, 6, 7, 8, 9, or 10 carbon atoms.

Figure 2:
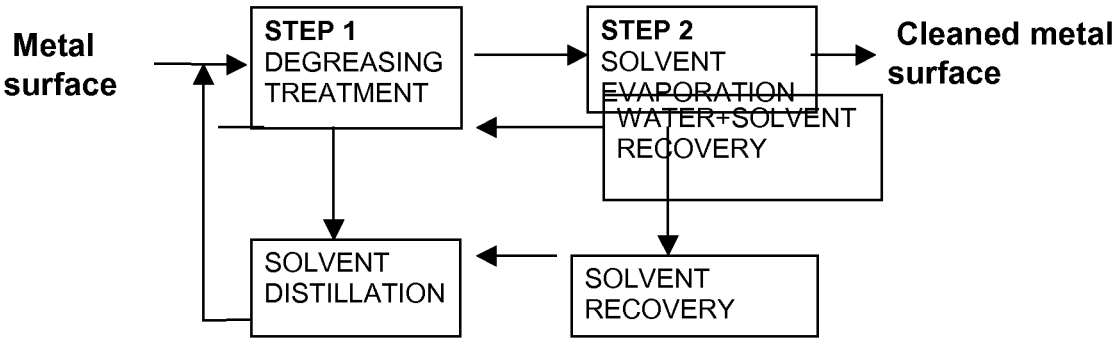
FIG. 2 indicates the process steps for a metal degreasing operation in which the solvent is ultimately eliminated by evaporation.

Said contact between the composition of the present invention and the metal surface can be carried out either:

a) by spraying the composition of the present invention onto the metal surface; or b) by immersing the metal surface into the composition of the present invention, optionally using ultrasounds. (see FIG. 2)

Figure 1:
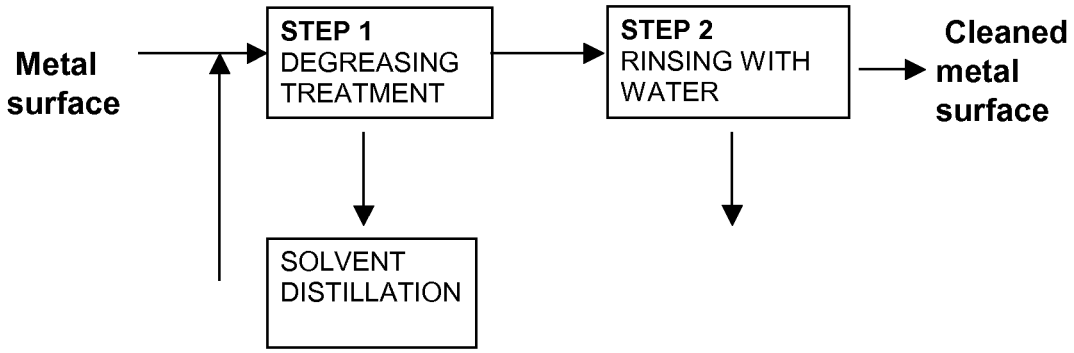
FIG. 1 shows a flow chart of a degreasing process using the solvent composition of the present invention with an optional water rinsing.

The remaining composition on the metal surface after the degreasing treatment, i.e. the contact between the degreasing composition and the metal surface, can be removed either by forced evaporation (via hot air stream or evaporation at reduced pressure) (see FIG. 2) or alternatively by water rinsing (see FIG. 1). Both the solvent composition and water can be separated and reused in the respective processes.

In contrast to aqueous degreasing formulations, the use of compositions of the present invention avoids the generation of waste water streams, significantly reducing thereby the environmental management costs. In addition, the low vapor pressure of the levulinate esters (less than 0.1 hPa at 25° C.) minimizes the generation of diffuse emissions to the atmosphere. These properties, combined with the high reusability and recyclability of levulinate esters, allow to establish a safe, efficient and cost effective process ultimately delivering a metal surface adequately conditioned for immediate use in subsequent steps of the metal finishing process.

The third object of the present invention relates to the use of a composition comprising at least one levulinic acid ester according to general formula (I)

$$CH_3CO(CH_2)_2COOR^1 \quad (I)$$

in which $R^1$ is a linear or branched, saturated or unsaturated, aliphatic or aromatic, hydrocarbon radical having 2 to 56 carbon atoms, wherein said hydrocarbon radical is optionally hydroxysubstituted for degreasing a metal surface. Preferably, said $R^1$ is an hydrocarbon radical having 2, 3, 4, 5, 6, 7, 8, 9, or 10 carbon atoms, for degreasing a metal surface.

The following examples illustrate the present invention but they are not intended to limit the scope of the invention.

EXAMPLES

Comparative Example

Solvent Immersion followed by Rinsing with Water

For our evaluation, a comparative method was used in which removal efficacy (RE) of several alternative solvents are compared with RE value obtained for the industrial standard degreaser, trichloroethylene.

The removal Efficacy (RE) measures in percentage (%) the degree of removal of organic materials (metal protector and/or solvent) from the surface of metal parts. The removal efficacy test, the grease of ten metallic greased pieces was removed by degreasing process. The standard procedure is carried out by bringing the solvent into contact with ten metal pieces which were previously treated with the metal protector. The metal parts are immersed in the solvent without shaking during 10 minutes in one volume of fresh solvent followed by three consecutive washing cycles by immersion in clean water. The amount of organic material (grease and/or solvent) that was not eliminated by the assayed procedure was determined by direct weight after removal of organic residues from the metallic parts by standard cleaning procedure with trichloroethylene.

The removal efficacy (RE) for a standard degreasing solvent in industry, $CHCl{=}CCl_2$, is between 94-98% depending on the nature of the preservative (Table 1). These RE values were used to compare with the results obtained by assayed solvents and to determine their effectiveness compared with trichloroethylene.

TABLE 1

| Removal Efficacy (%) value for trichloroethylene | | |
|---|---|---|
| Preservative | A (solvent-based) | B (cereous-based) |
| RE (%) | 94.2 | 98.1 |

Preservative A is a solvent-based preservative Aromatic hydrocarbons are often used in preservative formulations.

Preservative B is a cereous-based preservative.

In comparison with a cereous-based preservative, a solvent-based metal protector leaves a thinner layer of preservative on the metal surface when the solvent is evaporated after the application.

Example 1

Degreasing Studies with Levulinic Ester Solvents (LAOC)

The degreasing efficacy of the LAOC solvent family was studied. These experiments remove the grease of ten greased pieces according to the procedure described before. This experiment was carried out for two different greases and the obtained results are described in table 2.

TABLE 2

| Removal Efficacy normalized to trichloroethylene for levulinic ester (LAOC) solvents | | |
|---|---|---|
| Solvent | Solvent-based preservative | Cereous preservative |
| Trichloroethylene | 100.0 | 100.0 |
| Ethyl levulinate (LAOC-2) | 53.0 | 70.9 |
| Propyl levulinate (LAOC-3) | 79.6 | 81.7 |
| iso-propyl levulinate (LAOC-3i) | — | 87.0 |
| Butyl levulinate (LAOC-4) | 79.0 | 99.9 |
| iso-butyl levulinate (LAOC-4i) | 87.8 | 96.4 |
| Pentyl levulinate (LAOC-5) | 37.7 | 89.3 |
| Hexyl levulinate (LAOC-6) | — | 56.0 |
| Octyl levulinate (LAOC-8) | — | 61.0 |

Figures in Table 2 are percent values.

Figure 3:
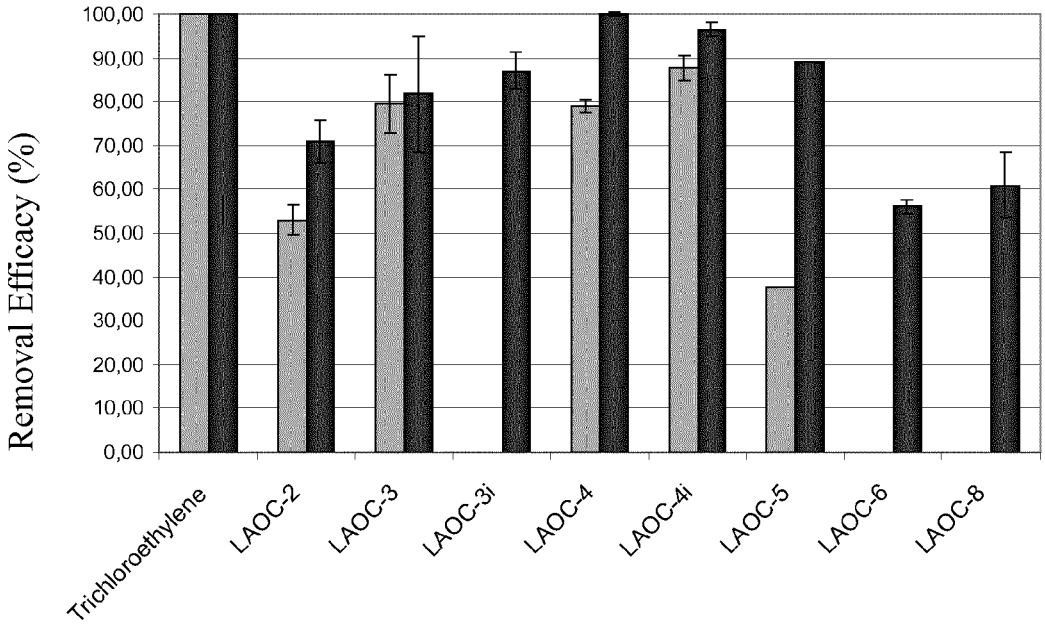
FIG. 3 shows a graph indicating the Removal Efficacy (%) value normalized to trichloroethylene for levulinic ester (LAOC) solvents. In all cases, the metal degreasing process is followed by water rinsing to eliminate excess solvent.

These results are also shown on a graph in FIG. 3.

Example 2

Recovery and Regeneration of Solvent

The recovery and reusability of solvents is critical in order to have an economically viable process. The reusability of butyl levulinate (LAOC-4) has been studied for both preservatives. The methodology involved the recovery and reuse of the solvent several times without any prior purification. The results are outlined in Table 3.

TABLE 3

| Reusability of LAOC-4 (values normalized to trichloroethylene = 100). | | |
|---|---|---|
| Number of cycles | Solvent based preservative | Cereous preservative |
| 1 | 74.4 | 98.0 |
| 2 | 78.2 | 93.2 |
| 4 | 62.2 | 93.4 |

TABLE 3-continued

| Reusability of LAOC-4 (values normalized to trichloroethylene = 100). | | |
|---|---|---|
| Number of cycles | Solvent based preservative | Cereous preservative |
| 7 | 69.7 | 85.9 |
| 10 | — | 84.6 |

The solvent-based preservative losses efficiency after 7 cycles. In the case of the cereous preservative, the solvent can be reused 10 times with an efficiency loss lower than 15%.

As indicated in Table 2, propyl and butyl levulinate isomer derivatives yield very promising degreasing values for the two preservatives tested and show excellent performance in removing stains, grease and especially preservatives from metal surfaces. Both solvents are an alternative to substitute trichloroethylene in metal degreasing. In addition, the solvents can be easily rinsed off with water, collected and then recycled without any additional purification.

Example 3

Immersion in a Ultrasound Bath and Solvent Evaporation

A general process of ultrasound degreasing followed by solvent evaporation has been developed. Two different representative metal parts were used to test the degreasing efficacy of LAOC-4. Firstly, a steel metal part with a low degree of degreasing resistance was used. Secondly, we tested a sinterized steel metal part which represents the most challenging and difficult metal part to degrease because of the intrinsic porosity of the sinterized materials (table 4).

TABLE 4

| Comparison of the operational parameters for the degreasing process with trichloroethylene (TRI) and LAOC-4. | | | | |
|---|---|---|---|---|
| | Surface degreasing of metal parts | | Degreasing of sinterized metal parts | |
| Solvent | TRI | LAOC-4 | TRI | LAOC-4 |
| Degreasing system | Immersion | Ultrasound | Immersion | Ultrasound |
| Temperature | 20° C. | 41° C. | 110° C. | 58° C. |
| Time | 3 min | 10 min | 3 h | 3 h |
| Solvent elimination | Evaporation | Evaporation | Evaporation | Evaporation |
| Conditions of solvent elimination | 3 min at 20° C. | 23 s at 117° C. | 120° C. | 3 h at 120° C., P < 1 mmHg |
| Removal efficacy (%) | 100 | 100 | — | — |
| Percentage of mass loss (%) | — | — | 0.93 | 0.97 |

LAOC-4 displays a similar degreasing efficiency than trichloroethylene (TRI) when steel metal parts are subject to ultrasound degreasing for 10 minutes in a solvent bath at 41° C. Evaporation is conducted with hot air current at 117° C. during 23 s (FIG. 3).

Figure 4:
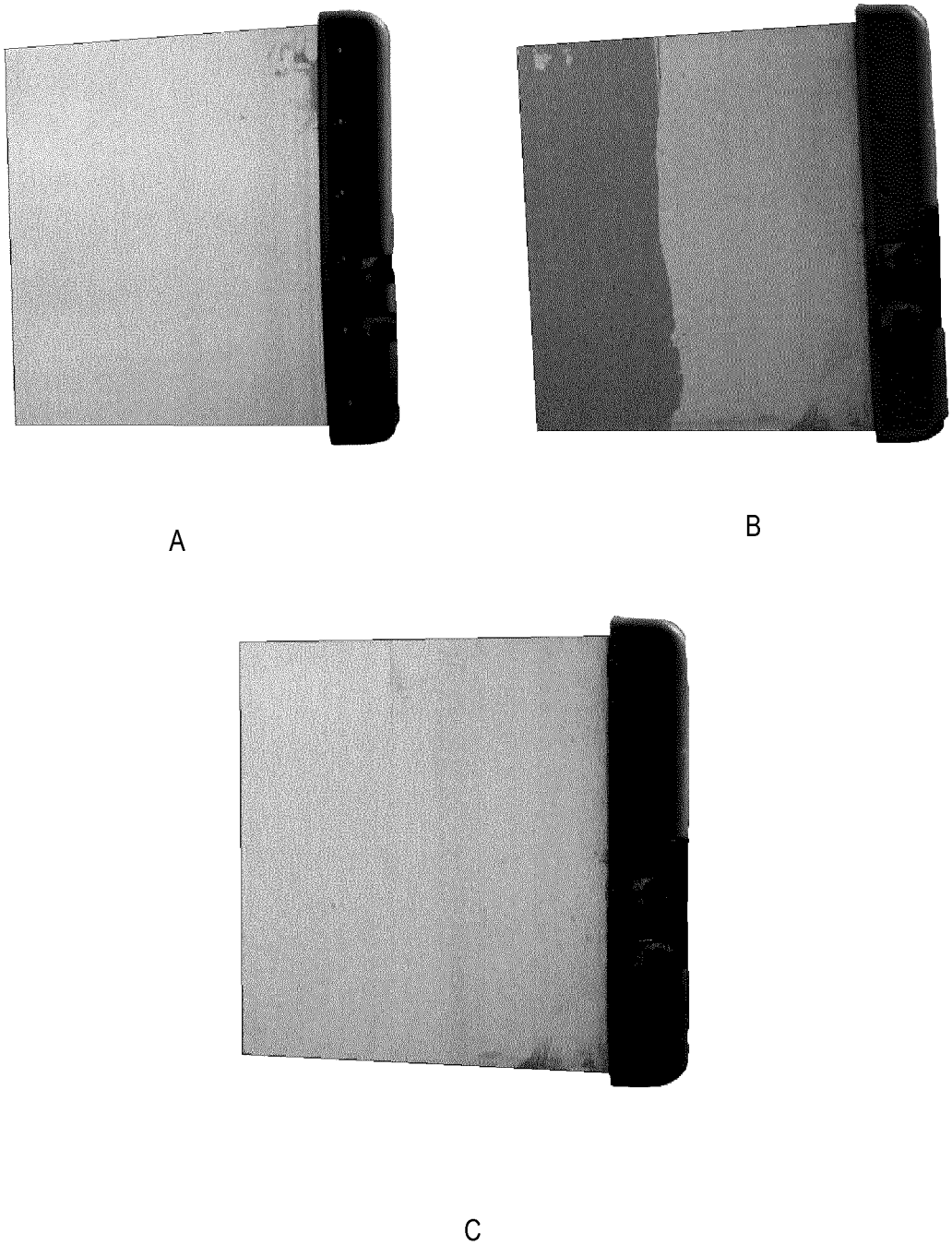
FIG. 4 shows examples of surface degreasing of metal parts according to example 3.

Sinterized metal parts subject to ultrasound degreasing followed by evaporation with hot air stream at 200° C., showed a partial deterioration of the metal part probably due to partial combustion of the solvent. However, when solvent evaporation is conducted at reduced pressure, LAOC-4 yielded better results than trichloroethylene (FIG. 4).

The invention claimed is:

1. A method for degreasing a metal surface comprising the step of contacting the metal surface with a composition comprising at least one levulinic acid ester according to general formula (I):

$$CH_3CO(CH_2)_2COOR^1 \quad (I)$$

in which $R^1$ is a linear or branched, saturated or unsaturated, aliphatic or aromatic, hydrocarbon radical having 2 to 56 carbon atoms, wherein said hydrocarbon radical is optionally hydroxysubstituted.

2. The method according to claim 1, wherein the $R^1$ is an hydrocarbon radical having 2, 3, 4, 5, 6, 7, 8, 9, or 10 carbon atoms.

3. The method according to claim 1, wherein the contact between the composition and the metal surface is carried out by spraying the composition onto the metal surface.

4. The method according to claim 1, wherein the contact between the composition and the metal surface is carried out by immersing the metal surface into the composition.

5. The method according to claim 1, wherein the remaining composition after the contact with the metal surface is removed by forced evaporation.

6. The method according to claim 1, wherein the remaining composition after the contact with the metal surface is removed by water rinsing.

7. The method according to claim 2, wherein the contact between the composition and the metal surface is carried out by spraying the composition onto the metal surface.

8. The method according to claim 2, wherein the contact between the composition and the metal surface is carried out by immersing the metal surface into the composition.

9. The method according to claim 2, wherein the remaining composition after the contact with the metal surface is removed by forced evaporation.

10. The method according to claim 2, wherein the remaining composition after the contact with the metal surface is removed by water rinsing.

11. The method according to claim 3, wherein the remaining composition after the contact with the metal surface is removed by forced evaporation.

12. The method according to claim 3, wherein the remaining composition after the contact with the metal surface is removed by water rinsing.

13. The method according to claim 4, wherein the immersion is an ultrasound immersion.

14. The method according to claim 4, wherein the remaining composition after the contact with the metal surface is removed by forced evaporation.

15. The method according to claim 4, wherein the remaining composition after the contact with the metal surface is removed by water rinsing.

16. The method according to claim 5, wherein the removed remaining composition is reused in the method.

17. The method according to claim 8, wherein the immersion is an ultrasound immersion.

18. The method according to claim 11, wherein the removed remaining composition is reused in the method.

* * * * *